US006386387B1

(12) United States Patent
Hwang

(10) Patent No.: US 6,386,387 B1
(45) Date of Patent: May 14, 2002

(54) MULTI-LAYER CONTAINER

(76) Inventor: Ja-Ling Hwang, No. 34, Lane 87, Fu I Street, Chi Tu, Keelung 206, Tainan (TW)

( * ) Notice: Subject to any disclaimer, the term of this patent is extended or adjusted under 35 U.S.C. 154(b) by 0 days.

(21) Appl. No.: 09/866,194

(22) Filed: May 25, 2001

(51) Int. Cl.[7] ..... B65D 25/00

(52) U.S. Cl. ..... 220/592.17; 220/662; 215/13.1; 215/379

(58) Field of Search ..... 220/592.17, 662, 220/665, 23.91; 215/13.1, 379

(56) References Cited

U.S. PATENT DOCUMENTS 3,002,646 A * 10/1961 Lewis ..... 220/662 X
4,372,453 A * 2/1983 Branscum ..... 215/13.1 X
4,789,073 A * 12/1988 Fine ..... 220/662 X
4,979,631 A * 12/1990 Krishnaukumar et al. .. 215/379 X
5,553,735 A * 9/1996 Kimura ..... 220/662 X
5,839,599 A * 11/1998 Lin ..... 220/662 X
6,264,054 B1 * 7/2001 Miyake et al. ..... 220/23.91 X

* cited by examiner

*Primary Examiner*—Steven Pollard

(57) ABSTRACT

A multi-layer container is constructed to include a transparent outer container body, the outer container body having a bottom center through hole and multiple peripheral through holes and an opaque design printed on an outer surface thereof, an inner container body mounted inside the outer container body, the inner container body having an opaque design printed on an outer surface thereof, and a transparent plastic lining filled up the gap in between the outer container body and the inner container body and the holes of the outer container body.

4 Claims, 6 Drawing Sheets

MULTI-LAYER CONTAINER

BACKGROUND OF THE INVENTION

The present invention relates to a container and, more particularly, to a multi-layer container, which comprises an inner container body and an outer container body respectively printed with a respective opaque design, and a transparent plastic lining directly molded in between the outer container body and the inner container body to fill up respective through holes of the outer container body.

FIG. 1 shows a regular single-layer container 100. Because the peripheral wall of this structure of container 100 has only one single layer, it is not suitable for holding a hot liquid. Using this single-layer container 100 to hold a hot liquid will scald the user's hand. FIG. 2 shows a double-layer container according to the prior art. This structure of double-layer container comprises an outer container body 201 and an inner container body 200 mounted inside and adhered to the inside wall of the outer container body 201. Because the inner container body 200 is adhered to the inside wall of the outer container body 201, the fabrication procedure of this structure of double-layer container is complicated. When the double-layer container falls to the ground, the inner container body 200 may easily be forced away from the outer container body 201.

SUMMARY OF THE INVENTION

The present invention has been accomplished to provide a multi-layer container, which eliminates the aforesaid drawbacks. It is one object of the present invention to provide a multi-layer container, which is easy and inexpensive to manufacture.

It is another object of the present invention to provide a multi-layer container, which can be used to hold hot liquid without scalding the user's hand.

It is still another object of the present invention to provide a multi-layer container, which is durable in use.

It is still another object of the present invention to provide a multi-layer container, which has an attractive design that attracts consumers to buy.

According to the present invention, the multi-layer container comprises a transparent outer container body, the outer container body having a bottom center through hole and multiple peripheral through holes an inner container body mounted inside the outer container body, the inner container body having multiple peripheral through holes, and a transparent plastic lining filled up the gap in between the outer container body and the inner container body and the holes of the outer container body and the inner container body.

According to another aspect of the present invention, the outer container body and the inner container body have a respective opaque design printed on the respective outer surface. Because the transparent plastic lining is directly molded on the outer container body and the inner container body, the outer container body and the inner container body are fixedly joined together, and the transparent plastic lining prohibits direct transmission of heat from the inner container body to the outer container body.

DETAILED DESCRIPTION OF THE PREFERRED EMBODIMENTS

Figure 2:
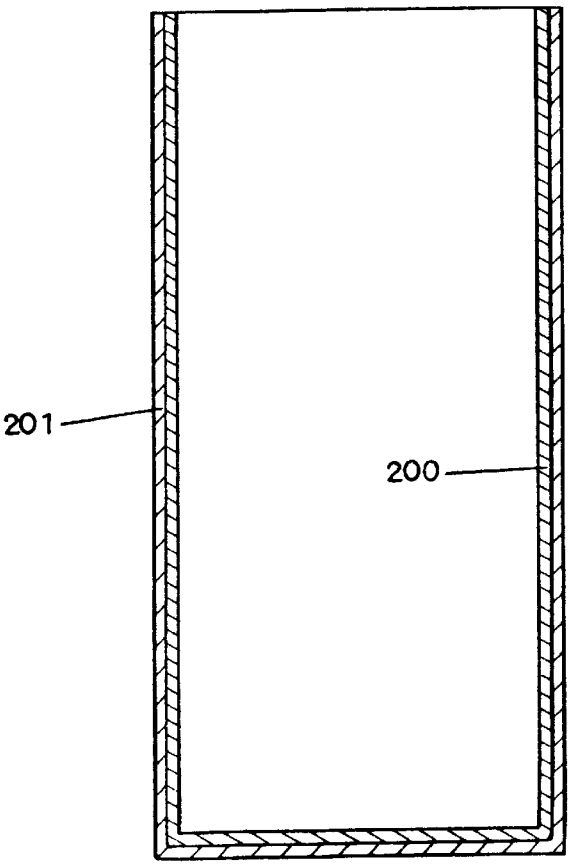
FIG. 2 is a sectional view of a double-layer container constructed according to the prior art.
Figure 1:
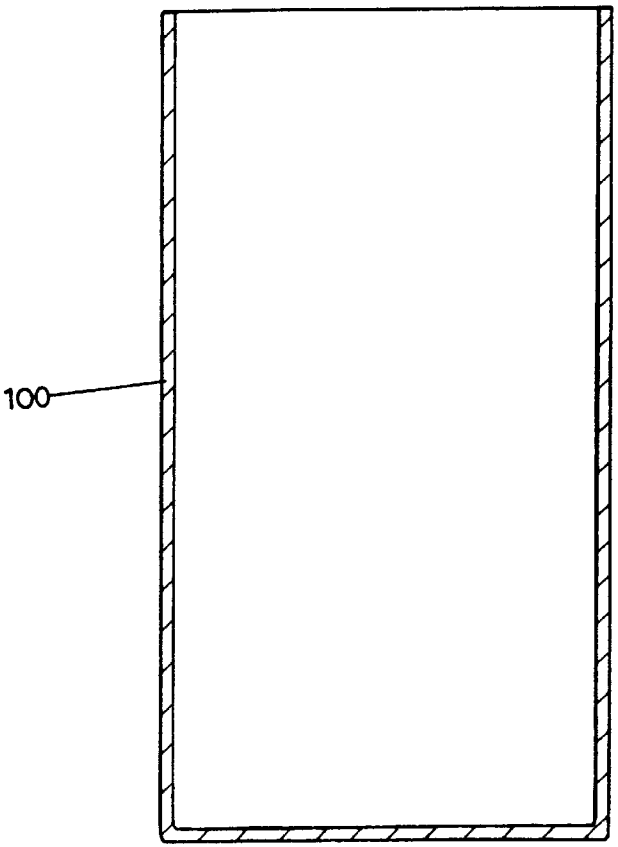
FIG. 1 is a sectional view of a single-layer container constructed according to the prior art.
Figure 3:
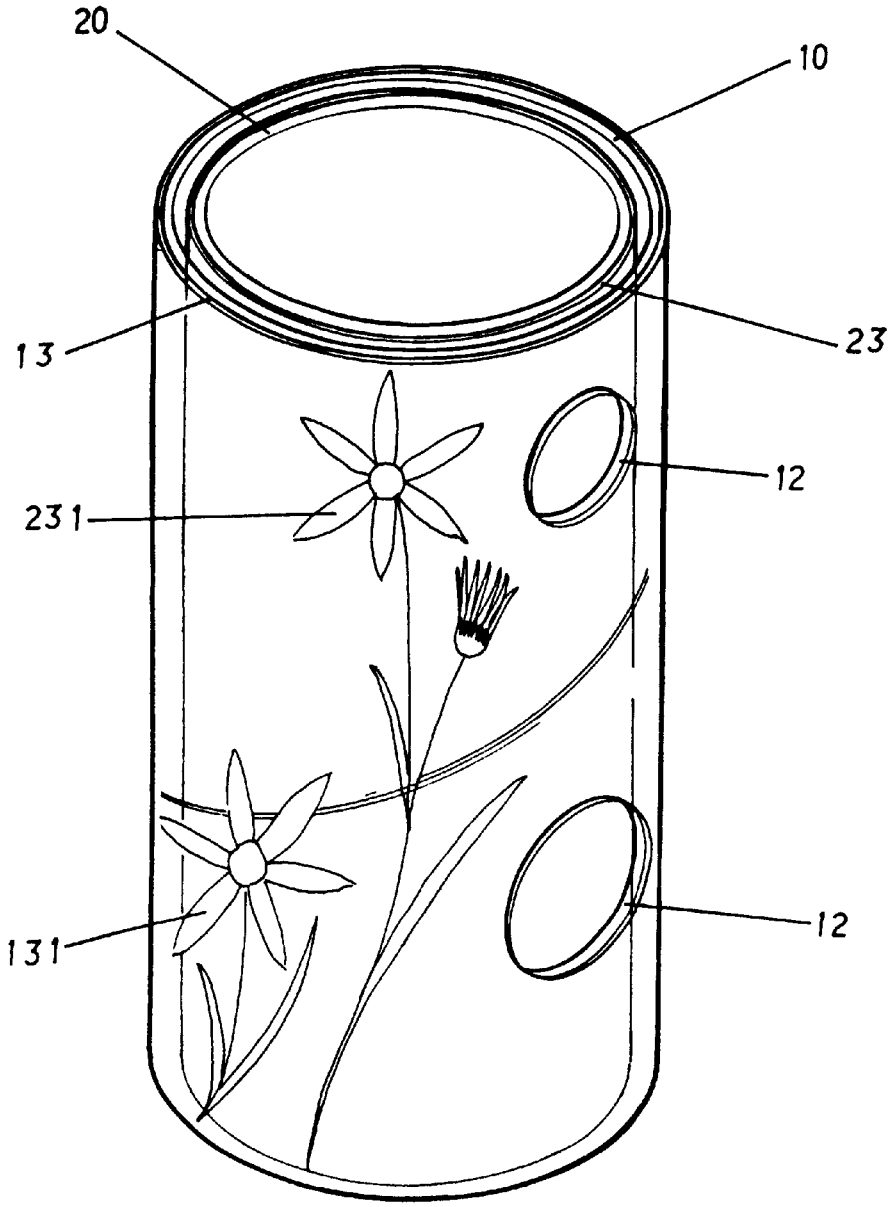
FIG. 3 is a perspective view of a multi-layer container constructed according to one embodiment of the present invention.
Figure 4:
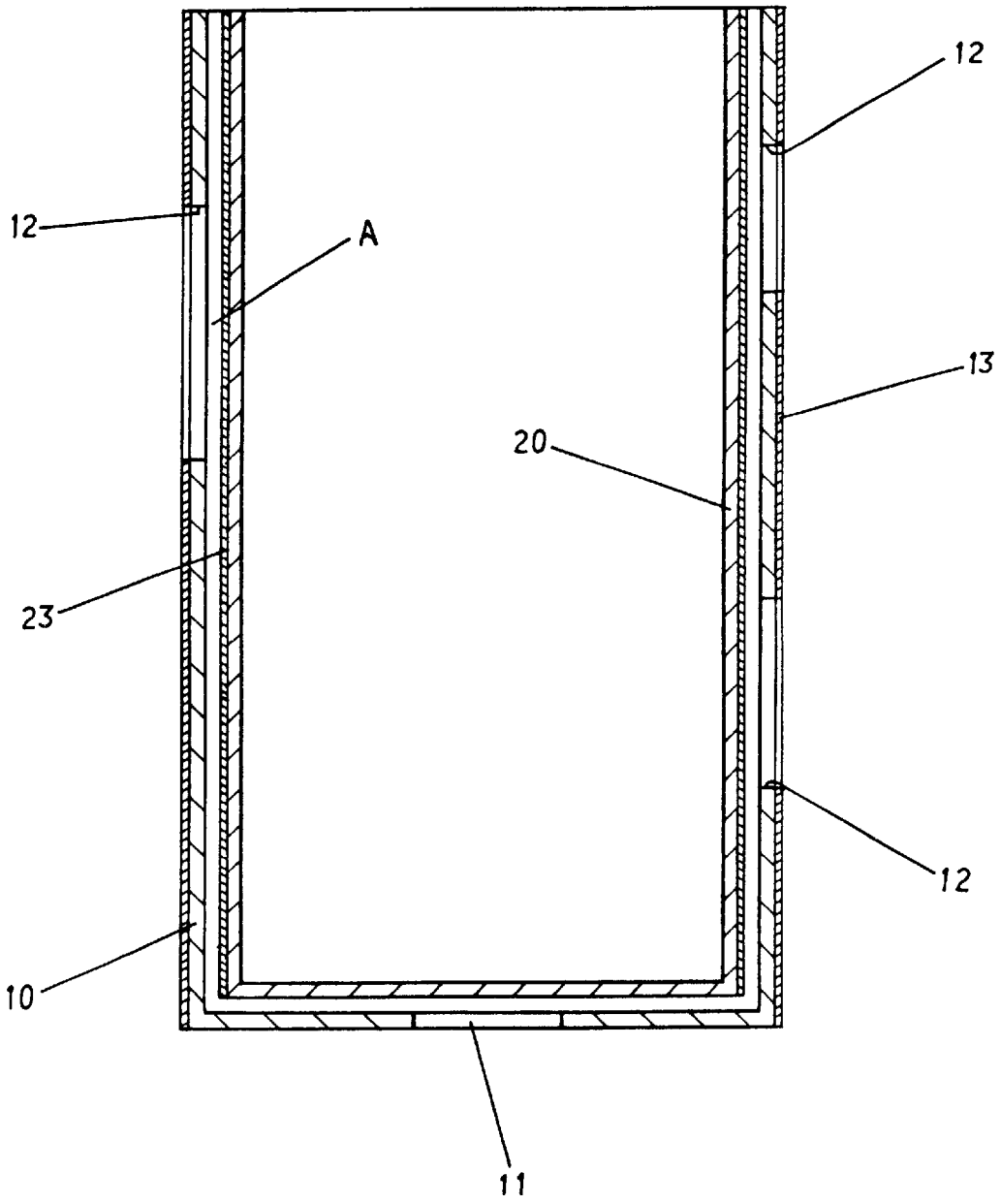
FIG. 4 is a sectional view of the present invention showing the inner container body put in the outer container body before the molding of the transparent plastic lining.
Figure 5:
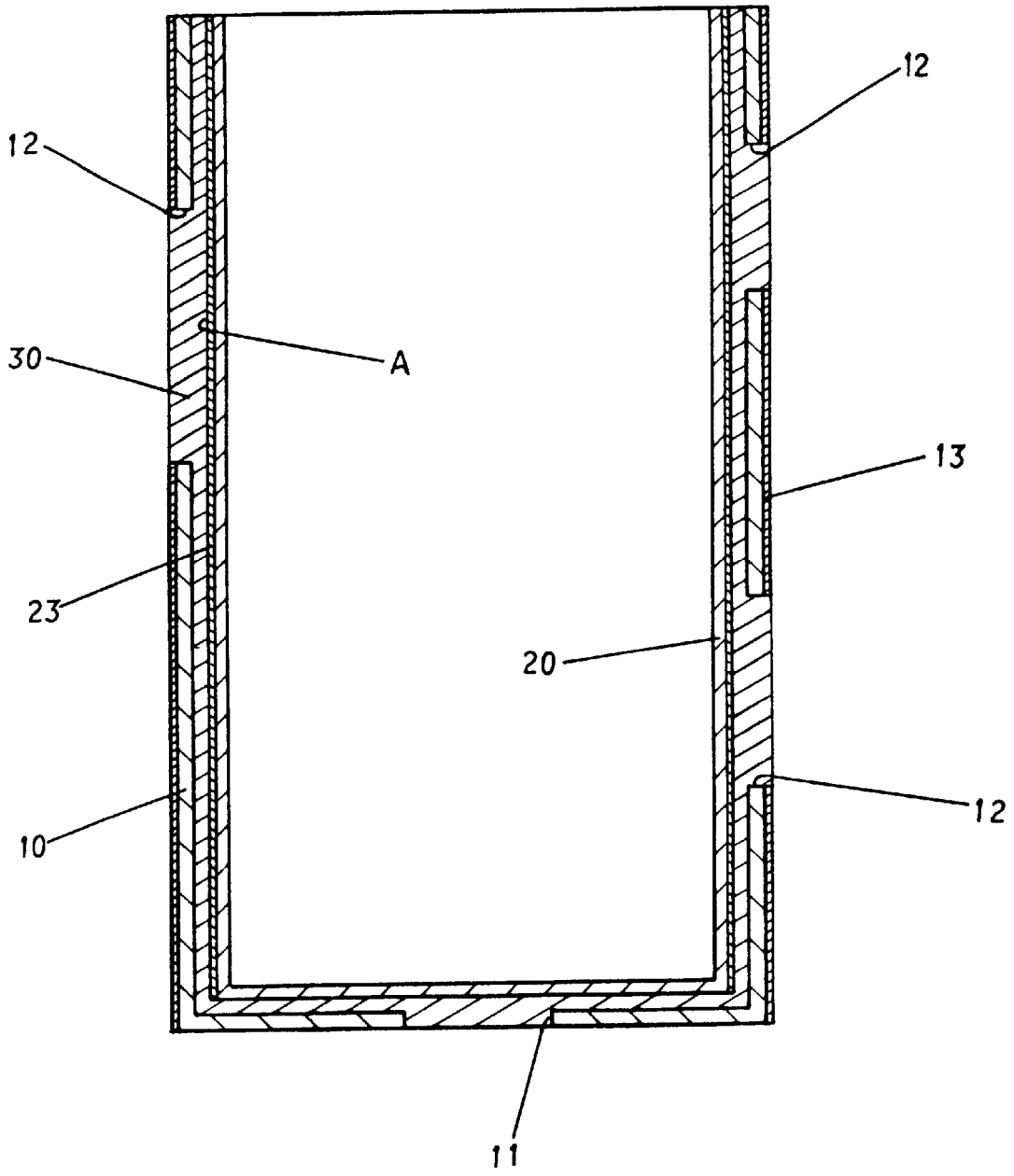
FIG. 5 is a sectional view of the present invention showing the transparent plastic lining filled up the gap between the inner container body and the outer container body and the holes of the outer container body.

Referring to FIGS. 3 through 5, a multi-layer container is shown comprising a transparent outer container body 10 having a bottom center through hole 11, an inner container body 20 mounted inside the outer container body 10, and a transparent plastic lining 30 filled up the gap A in between the outer container body 10 and the inner container body 20 and the bottom center through hole 11. The shape of the inner container body 20 is same as the outer container body 10, however the inner container body 20 has a relatively smaller size than the outer container body 10. The transparent plastic lining 30 is formed in between the outer container body 10 and the inner container body 20 by molding.

The main features of the invention are outlined hereinafter. In the embodiment shown in FIG. 5, the outer container body 10 has peripheral through holes 12, and the transparent plastic lining 30 fills up the peripheral through holes 12 of the outer container body 10. Further, the outer container body 10 and the inner container body 20 each have a plastic film covering 13 or 23 adhered to the respective outer surface. The plastic film covering 13 or 23 is printed with a design 131 or 231 that does not admit light (see FIG. 3).

As indicated above, the outer container body 10 and the plastic lining 30 are transparent, the design 231 of the plastic film covering 23 of the inner container body 20 is shown through the transparent plastic lining 30 and the outer container body 10. The distant contrast between the design 231 of the plastic film covering 23 of the inner container body 20 and the design 131 of the plastic film covering 13 of the outer container body 10 shows a strong visual effect. The transparent plastic lining 30 prohibits transmission of heat from the inner container body 20 to the outer container body 10. Using the multi-layer container to hold a hot liquid does not scald the user's hand. Further, because the transparent plastic lining 30 is directly molded on the outer container body 10 and the inner container body 20 to fill up the gap A between the outer container body 10 and the inner container body 20 and the bottom center through hole 11 and peripheral through holes 12 of the outer container body 10, the outer container body 10 and the inner container body 20 and the plastic lining 30 are formed in integrity and will not be separated from one another.

Figure 6:
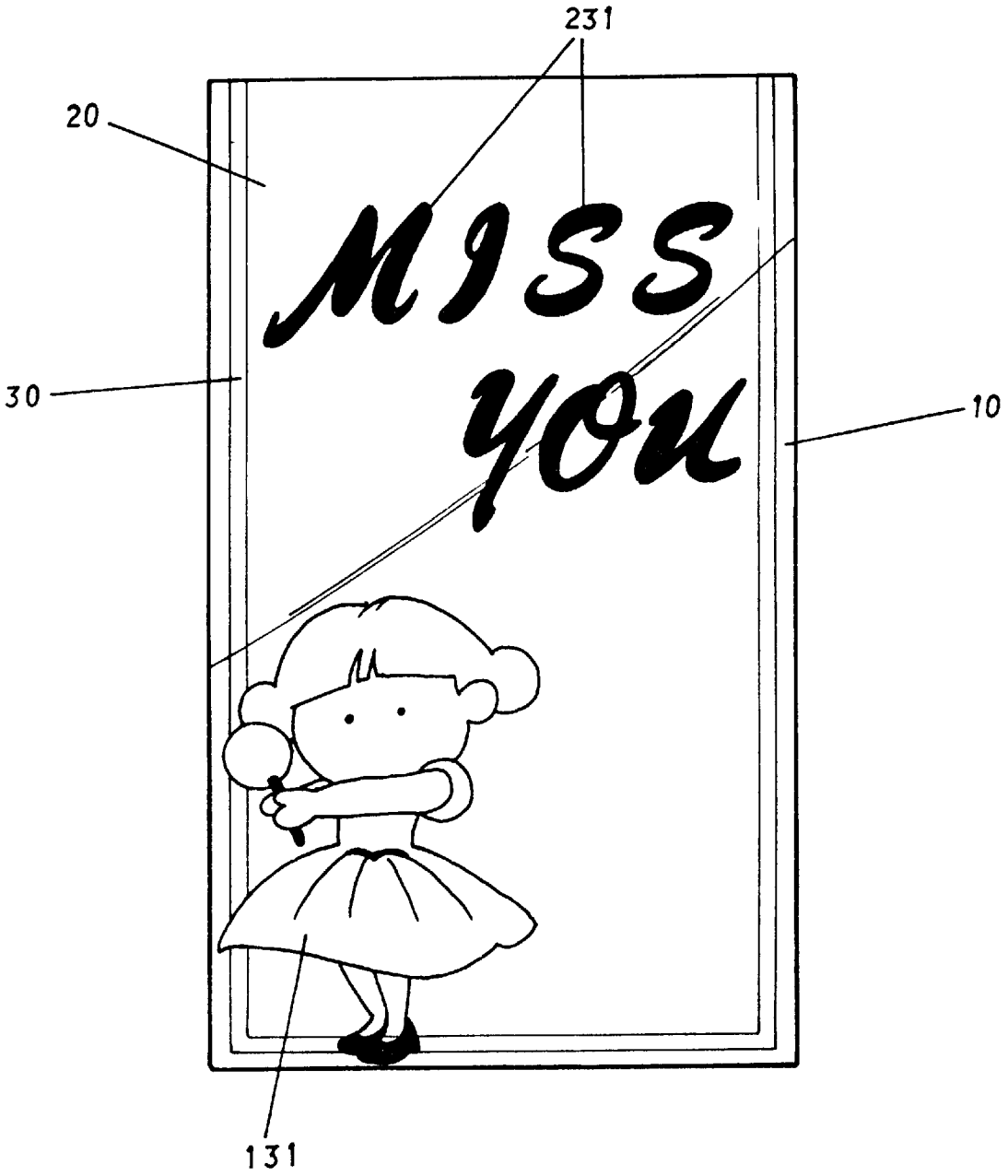
FIG. 6 is a plain view showing another example of printing design according to the present invention.
Figure 7:
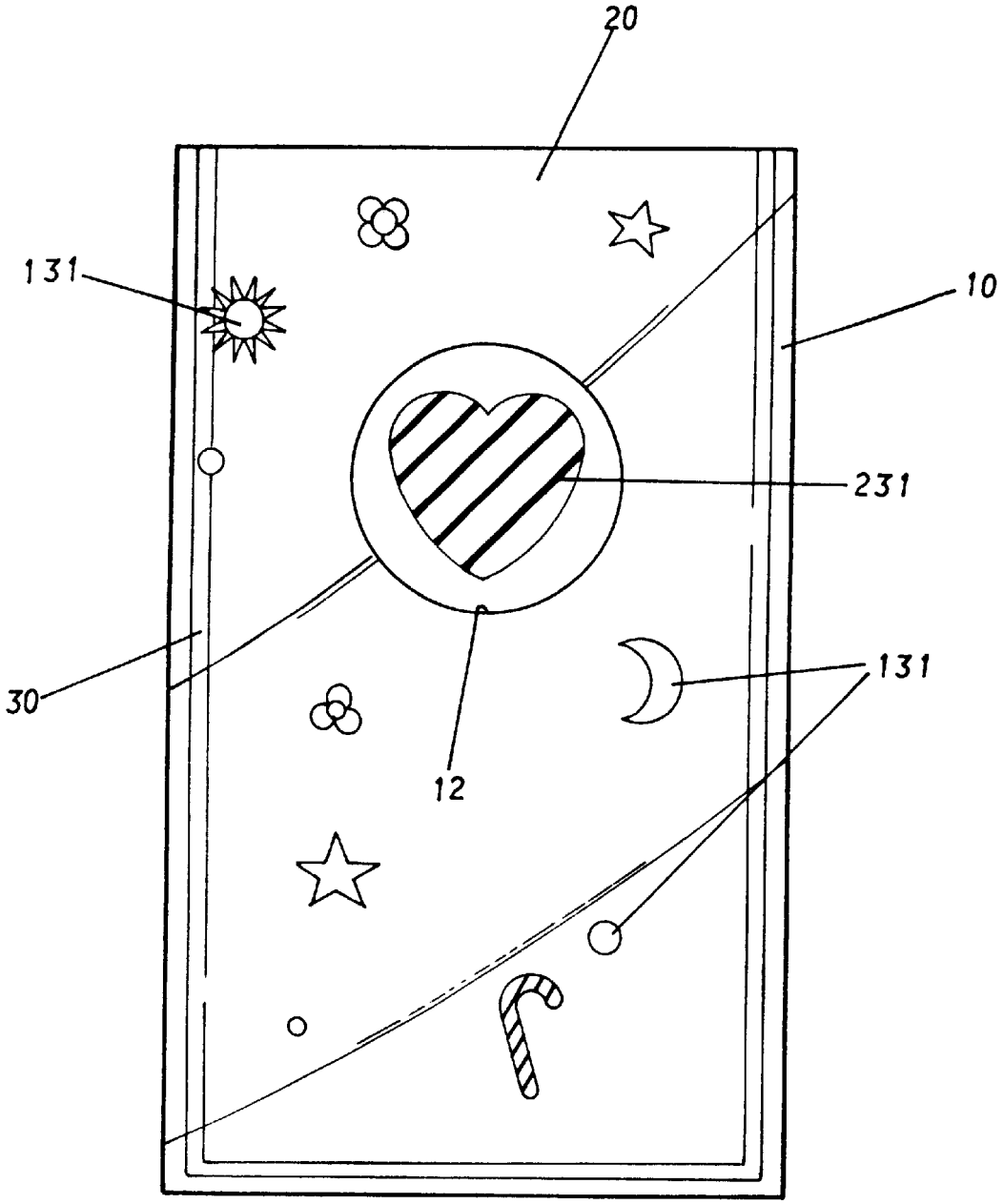
FIG. 7 is a plain view showing still another example of printing design according to the present invention.

Referring to FIGS. 6 and 7, the designs 131 and 231 can be respectively directly printed on the outer surface of the outer container body 10 and the outer surface of the inner container body 20.

A prototype of multi-layer container has been constructed with the features of FIGS. 3~7. The multi-layer container functions smoothly to provide all of the features discussed earlier.

Although particular embodiments of the invention have been described in detail for purposes of illustration, various modifications and enhancements may be made without departing from the spirit, and scope of the invention. Accordingly, the invention is not to be limited except as by the appended claims.

What the invention claimed is:

1. A multi-layer container comprising a transparent outer container body having a bottom center through hole, an inner container body mounted inside said outer container body and defining with said outer container body a gap, and a transparent plastic lining filled up the gap in between said outer container body and said inner container body and the bottom center through hole of said outer container body, wherein:

said outer container body has a plurality of peripheral through holes; said transparent plastic lining has a part engaged into the peripheral through holes of said outer container body; said inner container body has an opaque design on an outer surface thereof.

2. The multi-layer container of claim 1 wherein said outer container has an opaque design on an outer surface thereof.

3. The multi-layer container of claim 2 wherein the opaque design of said outer container body is printed on a plastic film being adhered to the outer surface of said outer container body.

4. The multi-layer container of claim 1 wherein the opaque design of said inner container body is printed on a plastic film being adhered to the outer surface of said inner container body.

* * * * *